United States Patent [19]

Massino

[11] 4,257,598

[45] Mar. 24, 1981

[54] BALL AND METHOD OF MAKING SAME

[75] Inventor: Chester F. Massino, Sandwich, Ill.

[73] Assignee: Ideas That Sell, Inc., Sheridan, Ill.

[21] Appl. No.: 54,310

[22] Filed: Jul. 9, 1979

Related U.S. Application Data

[63] Continuation-in-part of Ser. No. 930,716, Aug. 3, 1978, abandoned.

[51] Int. Cl.[3] ..... A63B 37/06; A63B 37/12; A63B 45/00

[52] U.S. Cl. ..... 273/60 R; 273/DIG. 20

[58] Field of Search ..... 273/199 R, 60 R, 58 A, 273/32 B, 60 A, 60 B

[56] References Cited

U.S. PATENT DOCUMENTS

| | | | |
|---|---|---|---|
| 1,653,893 | 12/1927 | Eden | 273/199 R X |
| 1,672,174 | 6/1928 | Ruedy | 273/60 R |
| 2,242,455 | 5/1941 | De Beer | 273/58 A |
| 3,310,879 | 3/1967 | Brzezinski et al. | 273/32 B X |
| 4,065,126 | 12/1977 | Mantz | 273/58 A |

OTHER PUBLICATIONS

"Belvidere Daily Republican" Oct. 21, 1975.

*Primary Examiner*—George J. Marlo
*Attorney, Agent, or Firm*—Leydig, Voit, Osann, Mayer & Holt, Ltd.

[57] ABSTRACT

Balls comprised of a (a) generally spherical-shaped center portion prepared from (1) a rolled-up piece of cloth, (2) preferably several wraps of yarn over the rolled-up cloth, and (3) preferably adhesive tape partially encasing the cloth and yarn, (B) yarn wound about this center portion, (C) adhesive tape substantially covering the yarn, and (D) a synthetic cloth cover (preferably a double knit polyester). The balls of this invention have substantially the same size, shape and performance characteristics (particularly the aerodynamic characteristics) of the balls they are meant to replace, i.e., baseballs or softballs, when thrown or hit; but are softer and lighter allowing for their use in congested areas—they do not travel as far when hit—and by or with young children who are more susceptible to injury with hard balls.

10 Claims, 11 Drawing Figures

FIG. 1
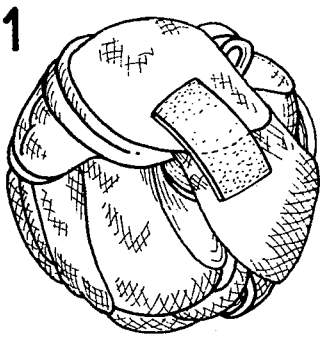
FIG. 2
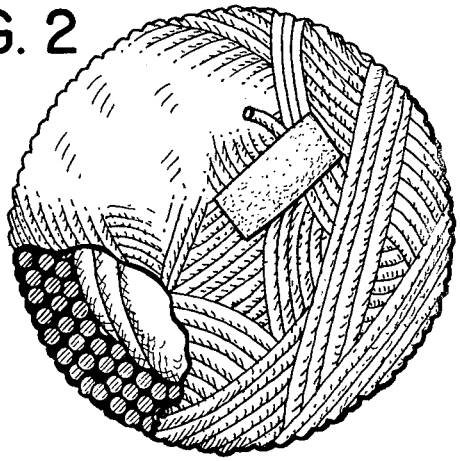
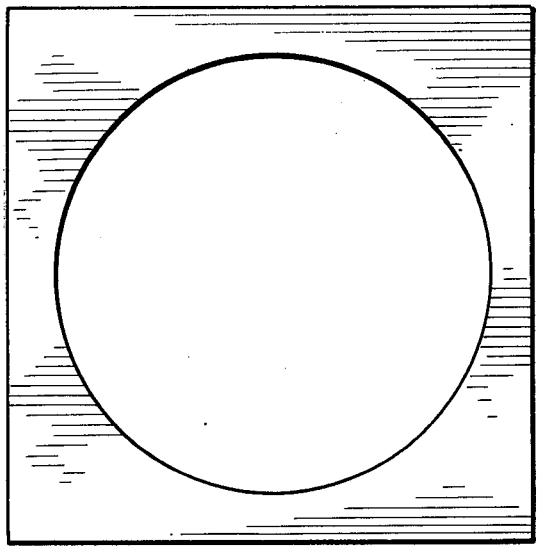
FIG. 3
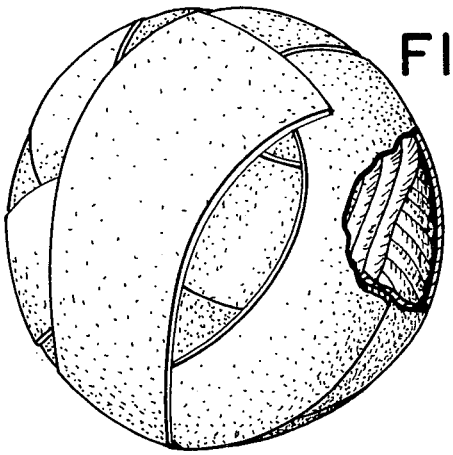
FIG. 4
FIG. 6
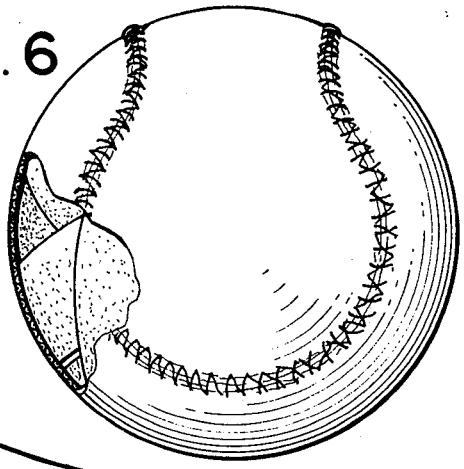
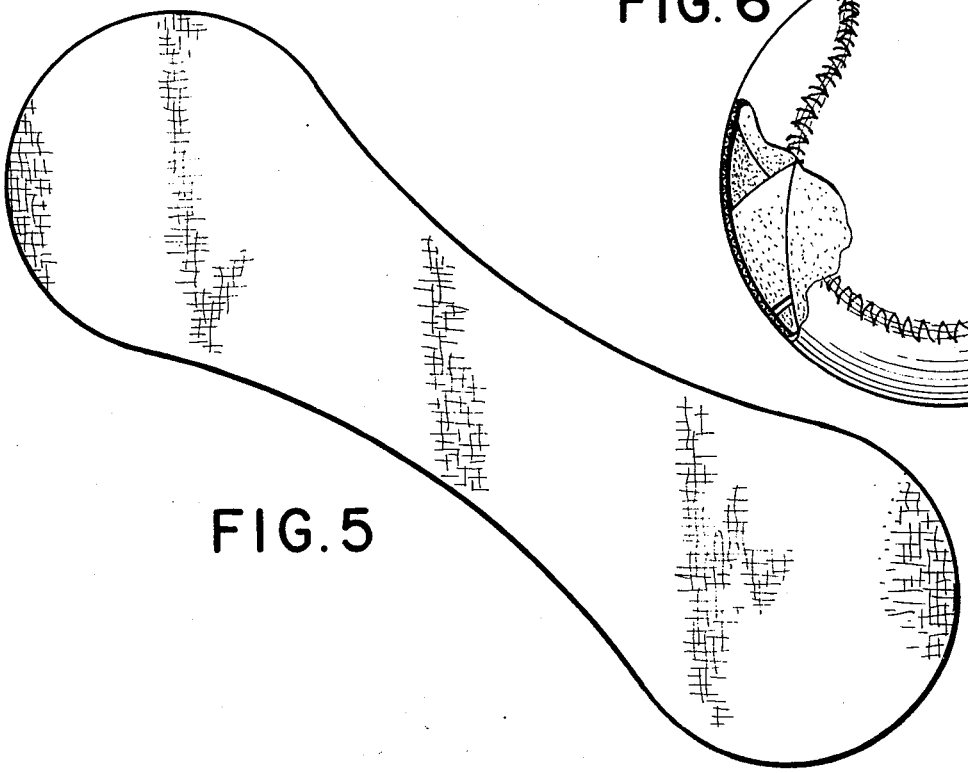
FIG. 5

BALL AND METHOD OF MAKING SAME

CROSS REFERENCES TO RELATED APPLICATIONS

This application is a continuation-in-part of my U.S. application Ser. No. 930,716, filed Aug. 3, 1978, now abandoned.

BACKGROUND OF THE INVENTION

This invention relates to balls, more particularly to balls which can be substituted for a baseball or conventional softballs (there are various types used as discussed hereinafter) where space is limited, where the players are more susceptible to injury by the use of a hard ball such as a baseball or conventional softball, and where the surrounding property is susceptible to damage, e.g., windows.

Baseballs and similar type balls having a relatively hard form, typically containing a resilient rubber center and a leather cover, have, of course, been used for years. A need for a lighter, softer and potentially less dangerous ball has long been recognized by the sporting industry. Various alternatives such as balls made of polyurethane foam, rubber, plastic or the like (the "Wiffle" ball is one example of this type of ball) have been manufactured but have met with limited success. While these lightweight balls have been used, they have not had a great degree of success because the performance characteristics of these substitutes have been substantially different from the conventional balls, e.g., baseballs, softballs, etc., that they have sought to replace and their durability has in many cases been less than desirable.

Lighter, softer and less dangerous balls which would still have the performance characteristics of a baseball or the various types of conventional softballs would be of substantial benefit to the sporting public for the following reasons: (1) the ability to play the game well could be learned while reducing exposure to injury; (2) the technical skills required to play the game well would still be required; (3) the skills could be learned and applied in confined spaces such as smaller playing fields, yards, and gymnasiums since the ball could not be hit as far; and (4) there would be less danger to the participants. The latter is of particular benefit with young children who have not yet developed the hand-eye coordination needed to catch a baseball or softball hit or thrown at high speed.

The subject ball can be used in organized team play for unique drills to develop batting and fielding skills from pre-Little League to university level. The drills were heretofore not possible as no safe alternative to a baseball (but having the needed performance characteristics of a baseball were available.

Drill #1.

A batter avoids being hit by a pitched ball. The ball described herein is thrown out of a pitching machine toward the head of the batter. The batter practices various techniques for avoiding being hit.

Drill #2.

Blocking drills for catchers. This drill (involving, e.g., preventing or blocking, a low pitch in the dirt from getting by him) when using a conventional baseball often results in soft tissue injuries. The balls of this invention enable the catcher to develop the necessary skills while avoiding these soft tissue injuries.

Drill #3. "Soft Hand Drill."

Catchers, outfielders and infielders catch high fly balls thrown from a pitching machine bare-handed to reduce proneness to errors.

The subject invention is directed to balls useful in the manner described above and the method of making them.

DESCRIPTION OF PRIOR ART

A ball having certain of the characteristics of this invention has been described in the prior art. In the Oct. 21, 1975 edition of the *Belvidere Daily Republican,* a daily newspaper published by the Belvidere Daily Republican Co. of Belvidere, Ill., a ball having a rag center which has been wound with yarn, covered with white adhesive tape and finished by stitching on a cloth cover is described. This ball while lighter than a baseball is characterized as being of almost the same size but much softer, allowing pitchers to throw "junk" pitches with greater ease. The distance the ball travels when hit is described as greatly reduced.

SUMMARY OF THE INVENTION

According to the invention, balls noticeably lighter and softer than conventional baseballs or conventional softballs they are meant to replace but being durable and having the general appearance, size, shape and performance characteristics of conventional baseballs or conventional softballs (particularly the aerodynamic characteristics) are provided. The balls are comprised of a spherical center portion prepared from a cloth core preferably rolled into a generally cylindrical shape (with a height about equal to the diameter of the cylinder and which preferably has then had several wraps of yarn placed over it and which has then been partially covered with adhesive tape). The resulting generally spherical-shaped center portion is then wound with yarn and this structure is in turn substantially completely covered with adhesive tape. This interior spherical-shaped structure is then finished by covering it with a synthetic cloth cover (preferably by sewing a properly shaped double-knit polyester cloth cover in place). The generally spherical-shaped center portion can also be prepared by rolling and stuffing a piece of cloth into a generally spherical shape to form the core, and then securing the core in this configuration with one or more pieces of adhesive tape.

BRIEF DESCRIPTION OF THE DRAWING

FIG. 1 is a perspective view of the spherical center portion of the ball prepared by rolling a piece of cloth into a generally spherical shape and securing it in this configuration with a piece of adhesive tape. This represents the first stage in one embodiment for manufacturing a ball of this invention.

FIG. 2 is a partially cut away perspective view of the interior of a ball of this invention after the cloth center portion has been covered with yarn.

FIG. 3 is a view of the pattern mold preferably used to size the ball.

FIG. 4 is a partially cut away perspective view of the interior of the ball after it has been covered with adhesive tape.

FIG. 5 is a view of one of two identical cloth pieces preferably used for the cover.

FIG. 6 is a partial cut away perspective view of the finished ball.

DETAILED DESCRIPTION OF THE INVENTION

Figure 7:
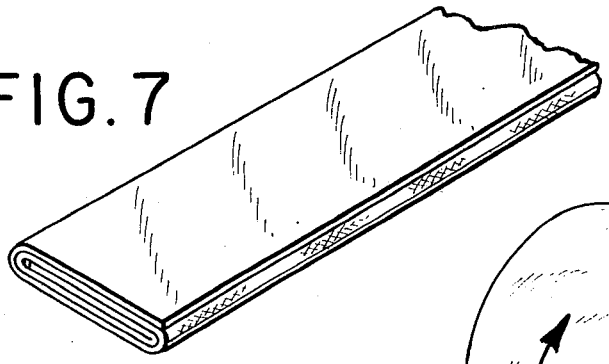
FIG. 7 is a perspective view of the strip of cloth used to prepare the core of the ball folded over on itself preparatory to it being rolled up to form the generally cylindrical-shaped configuration described below.

The present invention is predicated on the discovery that by the proper selection of materials and the proper manufacturing technique, balls having the general appearance, size, shape and characteristics of conventional baseballs or conventional softballs can be produced. However, the balls of the subject invention require less space—a smaller field—in which to play since the balls do not travel as far when hit. Additionally, there is less danger to limb and property since the balls are softer and lighter reducing the likelihood of broken windows and damage to individuals struck by the balls.

The following detailed description of the method of manufacture refers in part to the figures briefly described above and is generally applicable to substitute baseballs and substitute softballs. Where a particular alternative technique or step that may be used is either not disclosed in the figures, can be modified from the technique shown therein or is particularly applicable to a particular type of substitute ball, this is specifically described below.

According to the invention and referring to the drawings, a piece of cloth is rolled into a generally spherical shape to form the core of the ball (FIG. 1). The cloth can also be brought to the desired generally spherical shape by a combination of stuffing and rolling of the cloth.

As shown in FIG. 1, this generally spherical-shaped center portion is maintained in this configuration by a piece of adhesive tape. Several pieces of tape may be used.

Figure 7A:
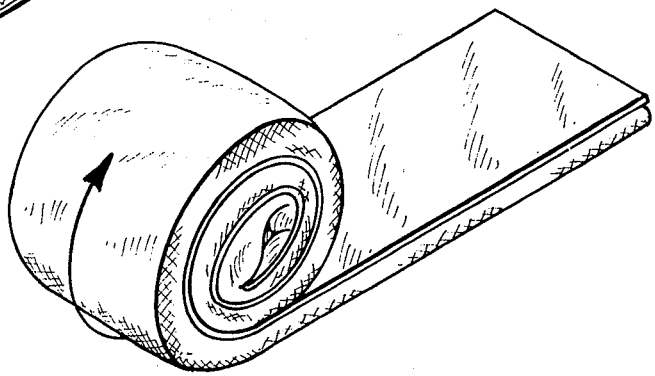
FIG. 7*a* is a perspective view of the core showing it in the initial stage of being rolled up.
Figure 7B:
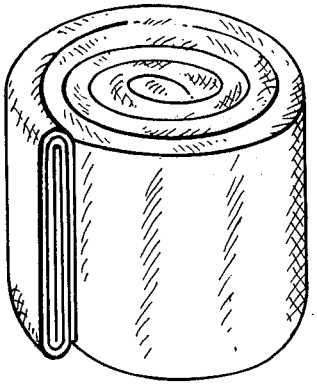
FIG. 7*b* is a perspective view of the core after the rolling up process has been completed and the generally cylindrical-shaped configuration of the core has been formed.
Figure 8:
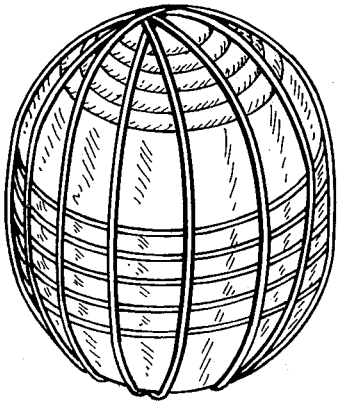
FIG. 8 is a perspective view of the core after several wraps of yarn have been made about the cloth core securing the core against unrolling and initiating the rounding process to form a generally spherical-shaped configuration from the initial generally cylindrical-shaped configuration.

As one preferred alternative technique for preparing the generally spherical-shaped center portion of the ball, the piece of cloth used for the core can be folded over on itself along one (or both) long side to form a strip, preferably about 1½ to about 2 inches wide, most preferably about 1¾ inches wide, and about 20 inches long. (FIG. 7) (A rectangular piece of cloth about 9 inches by about 20 inches is the preferred starting size for the cloth core when a ball having a nominal circumference of 9 inches (baseball size) is being produced.) This strip is then rolled up along the longitudinal axis (FIG. 7*a*) in such a manner as to maintain as uniform a density for the core as possible and to form a generally cylindrical-shaped core of about the same diameter as its height, i.e., about 1½ to about 2 inches (FIG. 7*b*). Preferably, several wraps of yarn (most preferably about 25 wraps using about 15 feet of yarn) are then used to secure the core in this configuration (to prevent the rolled-up cloth from unrolling) and to begin the process of "rounding" the generally cylindrical-shaped core to form the desired generally spherical-shaped center portion (FIG. 8). Adhesive tape is then preferably used to at least partially encase the yarn wrapped core to further secure the core in the desired configuration and to further assist in the "rounding" operation. Preferably the adhesive tape used will be three strips ½ to ¾ inches wide and about 8 inches long when the center portion is being prepared for a substitute baseball. Two strips are wrapped around the core over what was the ends of the cylinder but at 90° to each other (see FIG. 9). The other strip is wrapped around the circumference of the cylinder at about the midway point. The resulting center portion of the ball (FIG. 9) while perhaps still recognizable as having been derived from a cylindrical-shaped structure has had the corners of the ends of the cylinder rounded off and now has the desired generally spherical-shaped configuration.

A core that is as uniform as possible and that is located in as close to the exact center of the ball as possible is desired since a ball having an eccentric center or a center of varying weight and/or shape will not bounce true or perform in an accepted manner when thrown or hit.

The generally spherical-shaped center portion is then covered with yarn by winding yarn around the core in a random fashion while maintaining the spherical shape (FIG. 2). (In the preparation of softballs, some yarn may be wrapped around the center portion following which scrap yarn may simply be placed about the center portion, albeit winding of all the yarn is preferred.) In the situation where scrap yarn is placed about the center portion after the center portion has been partially wrapped with yarn, additional yarn is then wrapped about the scrap yarn to hold it in position and to complete this stage of the ball preparation process.

The correct size of the ball at this stage is obtained by either sizing the yarn-covered structure with a pattern mold (FIG. 3) or by measuring its circumference or diameter. For a substitute baseball (with a nominal 9 inch circumference) the yarn-covered structure prior to being covered with adhesive tape and the cover should preferably have a diameter of about 2 13/16 inches. The yarn-covered structure is in turn substantially completely (preferably completely) covered with adhesive tape (FIG. 4) and the finished ball is then prepared by fitting a synthetic cloth cover (FIG. 5 is representative of one of the two pieces preferably used for the cover) over the tape-covered interior portion of the ball and securing the cover in place (FIG. 6).

By synthetic cloth is meant cloth containing greater than fifty percent of a synthetic fiber such as polyester, nylon, etc. A cotton cover or the like is not desired since it is not as durable, particularly when the ball becomes wet and the seams tend to split open under the force of being hit by a bat. Polyester is the preferred cover material, particularly polyester double-knit.

Polyester cloth, particularly double-knit, is also the preferred starting material for the center portion, albeit other types of cloth can be used including, for example, wool.

A preferred starting size of cloth for the center portion (when a substitute baseball is being made) is a rectangular piece about 20 inches by 9 inches. The spherical center portion should preferably have a diameter of about 1½ to about 2 inches, preferably 1¾ inches. This spherical center portion is, as described above, covered with cloth yarn, preferably having a weight of about 2.5 ounces per 450 feet. Preferably about 200 to 220 feet of this yarn is used when making a substitute baseball. As a second preferred embodiment, yarn having a weight of about 3 ounces per 450 feet can also be used. In this case about 130 to 150 feet of the yarn is preferably used when making a substitute baseball. A variety of yarns may be used. Particularly preferred is 4 ply yarn containing 67 percent acrylic and 33 percent polyester. Various weights of yarn may be used, albeit yarn having a weight of from about 2 to about 3.5 ounces per 450 feet are preferred. Heavy yarns such as rug yarns are not desirable. When the yarn has been wound about the core, the substitute baseball at this stage should have a diameter slightly under 3 inches, preferably about 2 13/16 inches. Adhesive tape is then used to cover the yarn, preferably in its entirety and more preferably by the use of five strips of tape about 9 inches long and about 1½ inches wide.

The cover is then preferably prepared by cutting two pieces of synthetic cloth, preferably a double-knit polyester (but preferably of a lighter weight, e.g., about 6 ounces per square yard, than the material used for the center portion, e.g., about 8 ounces per square yard, in the shape shown in FIG. 5, i.e., two "FIG. 8's" which are placed over the ball and secured in place, preferably by sewing them with a raised stitch—the thread in the finished ball is preferably in part raised above the overall nominal surface of the ball—using any suitable thread. The finished substitute baseball will then have a diameter of approximately 3 inches. Preferably, the finished ball should weigh from about 2 to about 3 ounces, more preferably about 2¼ ounces to about 2½ ounces.

The use of polyester cloth for the cover, particularly double-knit polyester cloth, which has been cut to substantially the exact size of the ball and then stretched as it is being secured in place has been found to provide a durable, relatively firm ball which maintains its shape well. After the cover has been secured in place, the balls are preferably hot-air treated for about ten minutes to remove wrinkles. This hot-air treatment can be carried out in a conventional clothes dryer operating on the appropriate setting for synthetics such as polyester. The temperature used will typically be in the range of about 140° to about 155° F.

Any suitable method can be used to secure the cover over the interior of the ball. For example, the two pieces of the cloth cover can be partially sewn together using a decorative and raised stitch, prior to its application over the interior portion of the ball after which the cover is stitched closed. Polyester thread is particularly desirable because of its durability. The use of a raised stitch allows a pitcher to maintain greater control facilitating the throwing of "junk" pitches, e.g., a knuckle ball, slow curve, etc.

Various types of softballs are in use in the United States. These range from a 10 inch (in circumference) to the standard 12 inch (in circumference), to the large (16 inches in circumference) ball which enjoys popularity in certain areas of the United States. The amount of cloth used for the core of the ball and the amount of yarn used about the center used to prepare substitute softballs can be proportionate to the volumetric amount of these materials used in the substitute baseball described in detail above.

Figure 9:
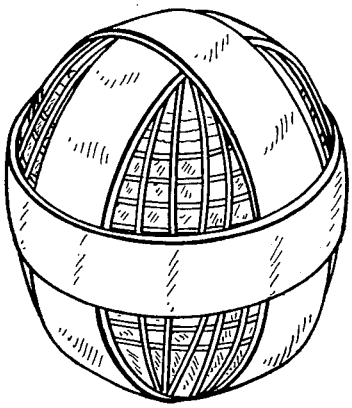
FIG. 9 is a view of the center portion after tape has been used to partially enclose the cloth core thereby further securing the core against unrolling and substantially completing the rounding of the cloth core.

For a standard 12 inch softball the cloth used for the core of the ball is preferably about 12 inches by 27 inches. The generally spherical-shaped center portion for the 12 inch softball is preferably about 2½ to about 3 inches in diameter, more preferably about 2¾ inches. As with the substitute baseball described in detail above, the core of the substitute 12 inch softball—as well as the 10 inch and 16 inch ball—is preferably prepared by forming a generally cylindrical-shaped core (see FIGS. 7, 7*a* and 7*b*) which is then rounded into a generally spherical shape by the use of adhesive tape and yarn (FIGS. 8 and 9). The amount of yarn which is then used to wrap the 12 inch softball is preferably about 2 to 3 ounces, more preferably about 2½ ounces of yarn having a weight of about 3 ounces per 450 feet. The yarn can be partially wrapped about the center portion of the ball, preferably with about 35 to 45 feet of the yarn, scrap yarn can then be placed about this interior structure, preferably about ¾ of an ounce, followed by winding an additional 170 to 200 feet, preferably about 185 feet, of yarn about the yarn that has been placed about the interior structure.

For the 16 inch ball, the cloth portion used for the core is preferably about 18 by 36 inches and when rolled to form a generally cylindrical-shaped core will measure from about 3 to about 4 inches, preferably about 3½ inches. The amount of yarn used can be proportionate on a weight and volume basis to that used in the 12 inch softball and the baseball.

It is apparent from the foregoing that the present invention provides new and useful balls and method for making the same for use in the conventional games of baseball and softball. The present balls can withstand substantial abuse, can be used on at least some conventional pitching machines, are washable, can be used by beginning players where the use of a conventional hard baseball or conventional softballs (referred to herein generically as recreational balls) would be potentially dangerous to the players and can be used where space is limited. The combination of the cloth core of substantially uniform density, yarn surrounding the generally spherical-shaped center portion (made up of (1) the cloth core, (2) preferably, several wraps of yarn, and (3) adhesive tape) and adhesive tape substantially covering the yarn wound center structure provides a ball which is "springy" and alive. It bounces true and gives most players using it a feeling of confidence in its performance and hence in their own.

It should be understood that various changes and modifications can be made in the details of the procedure, without departing from the scope and spirit of the invention; and, therefore, it is not intended to be limited except as indicated in the appended claims. For example, by increasing or decreasing the tension with which the yarn is wound about the spherical center portion, the amount of yarn used, the density with which the spherical center portion is prepared, etc., varying degrees of firmness and durability of the ball may be obtained. The adhesive tape preferably used in the balls of this invention may be substituted for by use of a spray on adhesive, resin or the like, albeit the resulting product prepared using presently available alternative products is not believed to provide as good a product as conventional and readily available adhesive tape.

I claim as my invention:

1. A recreational ball comprising:

(a) A spherical center portion of cloth of uniform construction;

(b) yarn randomly wound about said center portion;

(c) adhesive tape covering said yarn; and (d) a synthetic cloth cover;

said ball having the general appearance, size, shape and characteristics, particularly the aerodynamic characteristics, when thrown or hit of the conventional recreational ball it is meant to replace, but being softer and lighter.

2. The ball of claim 1 wherein said ball is a substitute baseball with a nominal circumference of 9 inches and said spherical center portion has a diameter of from $1\frac{1}{2}$ inches to 2 inches.

3. The ball of claim 2 wherein the yarn-covered interior portion of the ball (step (b) in claim 1) has a diameter of 2 13/16 inches.

4. The ball of claim 3 wherein the cloth used to form the spherical center portion of step (a) in claim 1 is a polyester double-knit measuring 9 by 20 inches, 200 to 220 feet of yarn having a weight of 2.5 ounces per 450 feet is present and said synthetic cloth cover is a double-knit polyester.

5. The ball of claim 4 wherein said cover is secured in place with polyester embroidery floss thread sewn in a raised stitch and said ball weighs from 2 to 3 ounces.

6. The ball of claim 1 wherein said spherical center portion (step (a) in claim 1) further comprises several wraps of yarn and adhesive tape.

7. The ball of claim 1 wherein said spherical center portion (step (a) in claim 1) has a diameter of from $2\frac{1}{2}$ to 3 inches in diameter and said ball has a nominal circumference of 12 inches.

8. The ball of claim 1 wherein said spherical center portion (step (a) in claim 1) has a diameter of from 3 to 4 inches in diameter and said ball has a nominal circumference of 16 inches.

9. A method for making a recreational ball comprising:

(a) forming a piece of cloth into a generally spherical shape of uniform construction to form the core of said ball;

(b) randomly winding yarn about said core while maintaining the spherical shape of the structure;

(c) substantially completely covering the yarn-covered spherical structure of step (b) with adhesive tape while maintaining the spherical shape of the structure; and (d) covering the tape-covered spherical structure of step (c) with a synthetic cloth cover.

10. The method of claim 9 wherein said center portion (step (a) in claim 9) is prepared by (a) folding a rectangular piece of cloth over on itself along one or both long sides to form a strip of the desired width comprising several layers of the cloth and as long as the longer side of said piece of cloth, (b) rolling said strip up along the longitudinal axis so that a generally cylindrical-shaped structure is formed, (c) wrapping yarn around said generally cylindrical-shaped structure of step (b) to secure the rolled-up piece of cloth in that configuration, and to initiate the process of rounding the generally cylindrical-shaped rolled-up piece of cloth to form the desired generally spherical-shaped center portion, and (d) wrapping adhesive tape around the yarn-wrapped core to at least partially encase the yarn-wrapped core to further secure the core in the desired configuration and to further assist in the rounding operation.

* * * * *